US007095270B2

(12) United States Patent
Liu

(10) Patent No.: US 7,095,270 B2
(45) Date of Patent: Aug. 22, 2006

(54) VOLTAGE SUPPLYING APPARATUS

(75) Inventor: Yu-Hua Liu, Hsinchu (TW)

(73) Assignee: Airoha Technology Corp., Hsinchu (TW)

( * ) Notice: Subject to any disclaimer, the term of this patent is extended or adjusted under 35 U.S.C. 154(b) by 13 days.

(21) Appl. No.: 10/989,506

(22) Filed: Nov. 17, 2004

(65) Prior Publication Data

US 2005/0104568 A1 May 19, 2005

(51) Int. Cl.
*G05F 3/02* (2006.01)

(52) U.S. Cl. ..... 327/540

(58) Field of Classification Search ..... 327/540, 327/538, 539, 565, 564
See application file for complete search history.

(56) References Cited

U.S. PATENT DOCUMENTS 5,488,288 A * 1/1996 Elmer ..... 327/362

* cited by examiner

*Primary Examiner*—Shawn Riley

(57) ABSTRACT

A voltage supplying apparatus is provided for supplying an output voltage to an electronic circuit. The electronic circuit includes a first voltage-drop device. The voltage supplying apparatus includes a current source for supplying a constant current, a second voltage-drop device, and a regulator. The second voltage-drop device is coupled with the current source and has the same feature in process deviation with the first voltage-drop device. The regulator for stabilizing the output voltage includes a voltage input terminal and a voltage output terminal. The voltage input terminal is coupled with the current source and has a first voltage corresponding to the output voltage. The voltage output terminal provides the output voltage and a corresponding output current. When the output current is deviated due to the process deviation of the first voltage-drop device, the first voltage will be shifted accordingly to offset the output current deviation.

20 Claims, 4 Drawing Sheets

VOLTAGE SUPPLYING APPARATUS

This application claims the benefit of Taiwan application Serial No. 92132345, filed Nov. 18, 2003, the subject matter of which is incorporated herein by reference.

BACKGROUND OF THE INVENTION

1. Field of the Invention

The invention relates in general to a voltage supplying apparatus, and more particularly to a voltage supplying apparatus preventing the breakdown of the electronic circuit coupled thereto due to the process deviation of a voltage-drop device.

2. Description of the Related Art

Ordinary electronic circuits such as a voltage control oscillator (VCO) must use a voltage supplier to provide a stable operating voltage Vcc. Referring to FIG. 1, a circuit diagram of a conventional voltage control oscillator coupled with a voltage supplier is shown. The conventional voltage supplier 100 includes a voltage generator 110 and a regulator 120. The voltage generator 110 is for providing a constant voltage Vs, i.e., a band gap reference voltage. The regulator 120 includes an amplifier 122 and a P-typed metal oxide semiconductor (PMOS) transistor P1. The amplifier 122 has its negative input terminal (−) coupled with the voltage generator 110 for receiving the constant voltage Vs and has its output terminal coupled with the gate electrode of the transistor P1. The resistor R2 and the resistor R1 are serially connected to the drain electrode of the transistor P1. The amplifier 122 has its positive input terminal (+) connected to the joint of the resistor R2 and the resistor R1 to form a feedback circuit. The drain electrode of the transistor P1 is for outputting an output voltage Vo. Therefore, the relation between the output voltage Vo and input voltage Vs is expressed as Vo=Vs*(R1+R2)/R1 according to the feedback circuit inside the regulator 120.

However, during wafer manufacturing process, the voltage-drop device included in VCO 130, a resistor R3 or a transistor N1 (or N3) for instance, normally requires a process of multi-layer masks. During the lithography manufacturing process, the resistor or the transistor located in the middle part of the exposure region of the same wafer can be manufactured with a higher accuracy than otherwise. That is to say, for transistors and resistors located in the middle part of the exposure region, their respective threshold voltage and resistance value are more accurate than those located in other parts thereof. The exposure region located in the edges of a mask is likely to have deviation in resistance value or threshold voltage due to the diffraction or reflection of the light. Besides, during the ion doping process, the density of the doping ions may vary with their locations on the wafer and thus the features of the devices on the wafer may also vary with their locations on the wafer. Normally, the deviation in resistance value or threshold voltage generated due to the process deviation is approximately ±20%. Since the voltage-drop devices have the process deviation, deviation in an input current Io of the VCO130 occurs. Moreover, when the input current Io is too weak, the normal operation of VCO130 will even be affected.

SUMMARY OF THE INVENTION

It is therefore an object of the invention to provide a voltage supplying apparatus. A current source is coupled to an input terminal of a regulator, and referring to the voltage-drop device included in the electronic circuit subsequently coupled to the regulator, a corresponding voltage-drop device having the same feature in process deviation is selected to be coupled to the current source. Therefore, when deviation occurs in the output current of the regulator due to the process deviation of the voltage-drop device of the electronic circuit, the corresponding voltage-drop device coupled with the current source will adjust the output voltage of the regulator due to the process deviation so as to offset the output current, lest the output current deviation might affect the normal operation of the electronic circuit.

According to the object of the invention, a voltage supplying apparatus for supplying an output voltage to an electronic circuit is provided, wherein the electronic circuit includes a first voltage-drop device, while the voltage supplying apparatus includes a current source, a second voltage-drop device, and a regulator. The current source is for supplying a constant current. The second voltage-drop device is coupled with the current source and has the same feature in process deviation with the first voltage-drop device. The regulator for stabilizing the output voltage includes a voltage input terminal and a voltage output terminal. The voltage input terminal is coupled with the current source and has a first voltage corresponding to the output voltage. The voltage output terminal for outputting the output voltage has the output current. When the output current is shifted due to the process deviation of the first voltage-drop device, the first voltage will be shifted accordingly to offset the output current due to the process deviation of the second voltage-drop device, lest the output current deviation might affect the normal operation of the electronic circuit.

According to the object of the invention, a voltage supplying apparatus for supplying an output voltage to an electronic circuit is provided. The output voltage corresponds to an output current, while the voltage supplying apparatus includes a voltage generator for providing a constant voltage, a regulator for stabilizing the output voltage, and a voltage comparer for adjusting the output voltage. The regulator includes a voltage input terminal, a first controlled terminal, a second controlled terminal, and a voltage output terminal. The voltage input terminal couples the voltage generator, while the voltage output terminal outputs the output voltage. The voltage comparer includes a current source, a second voltage-drop device, and a comparison unit.

The current source is for supplying a constant current, the second voltage-drop device is coupled with the current source, and the second voltage-drop device and the first voltage-drop device have the same feature in process deviation. The comparison unit includes a comparison input terminal, a first adjusting output terminal, and a second adjusting output terminal. The comparison input terminal couples the current source, and the comparison input terminal has a comparison voltage for comparing with the first biased voltage and the second biased voltage. The first biased voltage is smaller than the second biased voltage, and when the second voltage-drop device does not shift during the manufacturing process, the comparison voltage is between the first biased voltage and the second biased voltage. The first adjusting output terminal outputs a first adjusting signal to the first controlled terminal according to the comparison between the comparison voltage and the first biased voltage and the second adjusting output terminal outputs a second adjusting signal to the second controlled terminal according to the comparison between the comparison voltage and the second biased voltage.

When the output current is deviated due to the process deviation of the first voltage-drop device, the comparison voltage is shifted accordingly due to the process deviation of the second voltage-drop device. When the comparison voltage is shifted to be between the first biased voltage and the second biased voltage, the first adjusting signal is at a first level and the second adjusting signal is at a second level, and the output voltage is a normal voltage. When the comparison voltage is shifted to be smaller than the first biased voltage, the first adjusting signal is at a third level and the second adjusting signal is at the second level, and the output voltage is lower than the normal voltage so as to offset the output current. When the comparison voltage is shifted to be larger than the second biased voltage, the first adjusting signal is at the first level, the second adjusting signal is at a fourth level, and the output voltage is higher than the normal voltage so as to offset the output current.

The comparison unit disclosed above further includes a first comparer and a second comparer. The first comparer includes a first positive input terminal, a first negative input terminal and a first output terminal. The first positive input terminal receives the input of the first biased voltage, the first negative input terminal couples the comparison input terminal, and the first output terminal couples the first adjusting output terminal. The second comparer includes a second positive input terminal, a second negative input terminal and a second output terminal. The second positive input terminal receives the input of the second biased voltage, the second negative input terminal couples the comparison input terminal, and the second output terminal couples the second adjusting output terminal.

The regulator includes an amplifier, a PMOS transistor, a load circuit, a first switch, and a second switch. The amplifier includes a third negative input terminal coupling with the voltage input terminal, a third positive input terminal, and a third output terminal. The PMOS transistor includes a gate electrode coupling with the third output terminal and a drain electrode coupling with the voltage output terminal. The load circuit is serially connected between the drain electrode and the grounding terminal, and, starting from the drain electrode, serially connects a first resistor, a second resistor, a third resistor, and a fourth resistor in a sequential order to form a feedback circuit. The first switch, bridged over the first resistor, further includes a first input terminal coupling with the first controlled terminal. The second switch, bridged over the second resistor, further includes a second input terminal coupling with the second controlled terminal. When the first adjusting signal is at the first level, the first switch unit is not conducted, and when the first adjusting signal is at the third level, the first switch unit is conducted; whereas when the second adjusting signal is at the second level, the second switch is conducted, and when the second adjusting signal is at the fourth level, the second switch is not conducted. Therefore, the invention can prevent the deviated input current the normal operation of the electronic circuit.

Other objects, features, and advantages of the invention will become apparent from the following detailed description of the preferred but non-limiting embodiments. The following description is made with reference to the accompanying drawings.

DETAILED DESCRIPTION OF THE INVENTION

The key point of the voltage supplying apparatus of the invention lies in according to a first voltage-drop device of the electronic circuit coupled to the voltage supplying apparatus, a resistor and a transistor for instance, using a second voltage-drop device having the same process deviation with the first voltage-drop device to serially connect to a fixed current source, so that when the first voltage-drop device of the electronic circuit generates deviation in output current due to the process deviation, the second voltage-drop device will adjust the output voltage and offset the output current due to the process deviation, lest the normal operation of the electronic circuit might be affected. The two preferred embodiments below exemplify how the voltage supplying apparatus of the invention adjusts the output current according to the process deviation of the voltage-drop device to assure the normal operation of the voltage control oscillator coupled thereto.

Preferred Embodiment One

Figure 1:
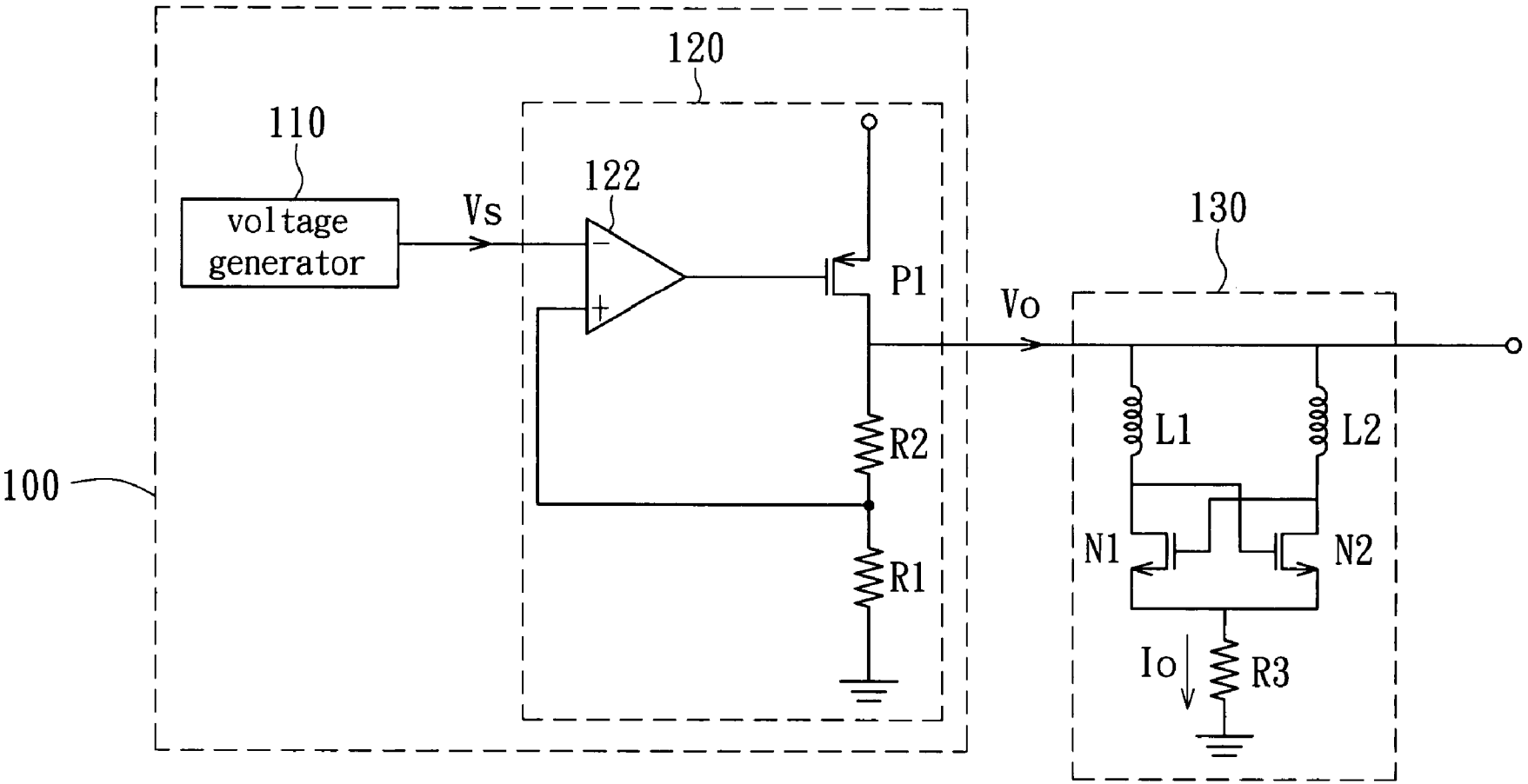
FIG. 1(PRIOR ART)
FIG. 1 is a circuit diagram of a conventional voltage control oscillator coupling with a voltage supplier.
Figure 2:
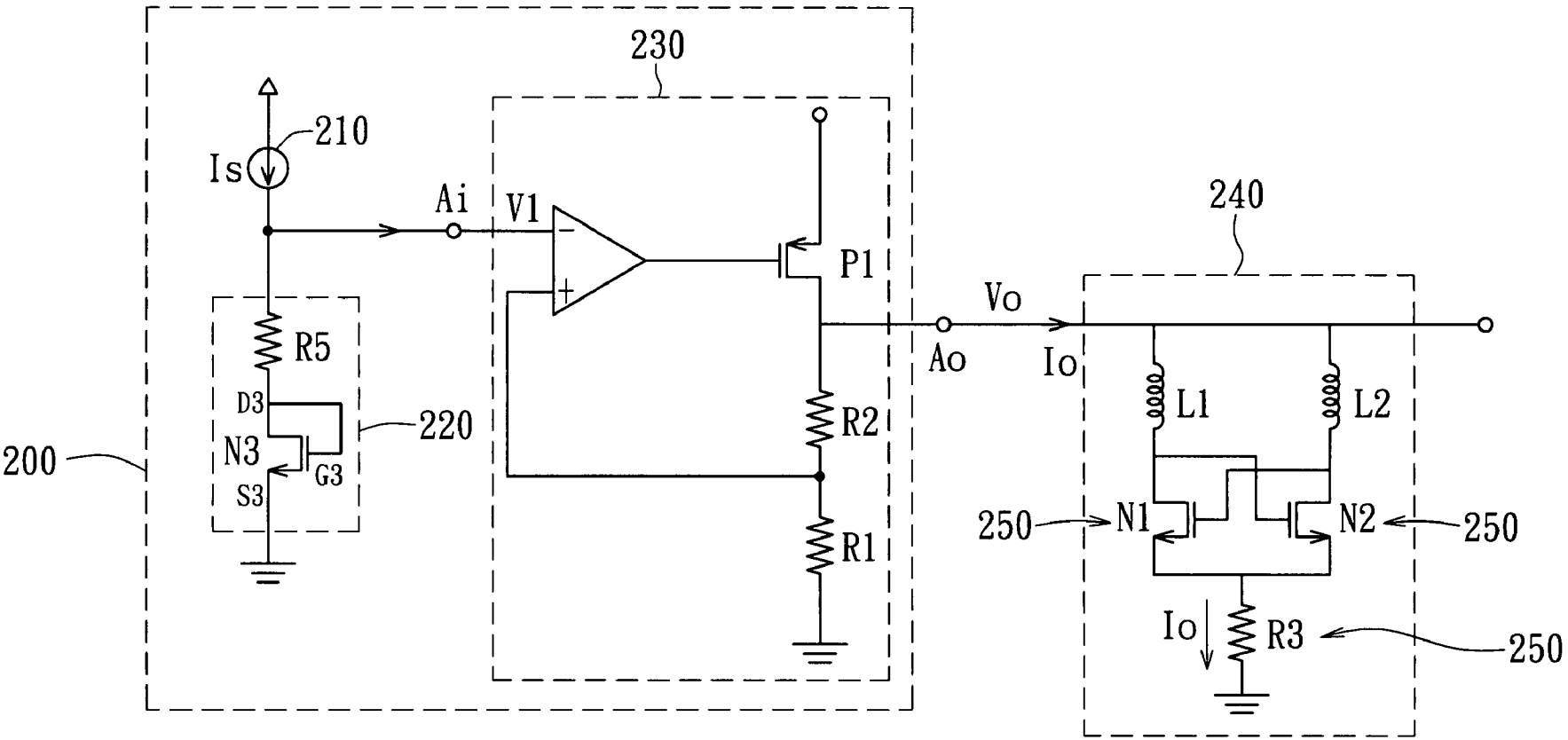
FIG. 2 is a circuit diagram of a voltage supplying apparatus according to the first preferred embodiment of the invention and a main circuit diagram of the VCO coupled thereto.

Referring to FIG. 2, a circuit diagram of a voltage supplying apparatus according to the first preferred embodiment of the invention and a main circuit diagram of the VCO coupled thereto is shown. The voltage supplying apparatus 200 is for providing an output voltage Vo, i.e., an operating voltage Vcc, to VCO 240 having a first voltage-drop device 250 such as a resistor R3, a transistor N1, or a transistor N2, wherein the transistors N1 and N2 are NMOS transistors and have the same feature in process deviation. The voltage supplying apparatus 200 includes a current source 210, a second voltage-drop device 220, and a regulator 230. The current source 210 is for providing a constant current Is, the second voltage-drop device 220 is coupled with the current source 210, and the second voltage-drop device 220 has the same feature in process deviation with the first voltage-drop device 250.

According to the contents of the first voltage-drop device 250, including the resistor R3 and the transistor N1 (or N2) mentioned above, the second voltage-drop device 220 including the resistor R3 and the transistor N3 serially connected to the resistor R3. The transistor N3 is the same type NMOS transistor like the transistor N1 or N2, and the gate electrode G3 of the transistor N3 is couple with the drain electrode D3. As mentioned above, the second voltage-drop device 220 and first voltage-drop device 250 have the same feature in process deviation. That is to say, the resistor R5 and the resistor R3 have the same direction in resistance deviation caused by temperature deviation or process deviation, and that the transistor N3 and the transistor N1 or N2 have the same direction in threshold voltage deviation caused by temperature deviation or process deviation.

As disclosed in the prior art, the devices located in different positions of the same wafer may have different features in process deviation. In the other hand, the adjacent elements have similar features due to the similar manufacturing conditions. The second voltage-drop device 220 according to the preferred embodiment can be chosen from a device whose position on the wafer as manufactured is close to the first voltage-drop device 250. By doing so, different sizes though the second voltage-drop device 220 and the first voltage-drop device 250 may have, their manufacturing conditions may be similar, allowing the second voltage-drop device 220 and the first voltage-drop device 250 to have the same feature in process deviation. That is to say, when the first voltage-drop device 250 corresponds to devices located in the middle part of the exposure region, the second voltage-drop device 220 chosen also corresponds to the devices located in the middle part of the exposure region. Meanwhile, both the first voltage-drop device 250 and the second voltage-drop device 220 will have a resistance value or a threshold voltage with a higher accuracy. On the contrary, when the first voltage-drop device 250 corresponds to devices located in the exposure region at the edge of the mask, the second voltage-drop device 220 chosen also corresponds to devices located in the exposure region at the edge of the mask. Meanwhile, both the first voltage-drop device 250 and the second voltage-drop device 220 will have a resistance value or threshold voltage with a lower accuracy. By choosing the second voltage-drop device 220 and the first voltage-drop device 250 with similar manufacturing conditions, the second voltage-drop device 220 and the first voltage-drop device can have the same feature in process deviation, thus the object of the invention can be achieved.

The regulator 230 for stabilizing the output voltage Vo includes a voltage input terminal Ai and a voltage output terminal Ao. The voltage input terminal Ai couples the current source 210 and has a first voltage V1 corresponding to the output voltage Vo. The voltage output terminal Ao is for outputting the output voltage Vo and the corresponding output current Io. It can be known from the feedback circuit inside the regulator 230 in FIG. 2 that a direct proportion exists between the voltage V1 and voltage Vo, that is, Vo=V1*(R1+R2)/R1. When the output current Io generates deviation due to the process deviation of the first voltage-drop device 250, the first voltage V1 is shifted according to the process deviation of the second voltage-drop device 220 so that the output voltage Vo is shifted accordingly to offset the output current Io.

As shown in FIG. 2, when the resistor R3 increases due to the process deviation, the output current Io corresponding to the output voltage Vo will decrease accordingly. Meanwhile, the resistor R5 will increase along with the process deviation. Refer to the equation voltage V1=Is*R5+$V_{GS}$, wherein $V_{GS}$ is the voltage drop of the gate electrode G3 and source electrode S3 of the transistor N3. When the value of V1 increases, the value of the output voltage Vo, which is direct proportional to V1, will also increase due to the processing of the regulator 230, so as to offset the decrease in the output current Io. On the contrary, when the resistor R3 decreases due to the process deviation, the output voltage Vo will decrease as well to offset the output current Io.

Similarly, when the threshold voltage Vt of the transistors N1 and N2 increases due to the process deviation, the $V_{GS}$ of the transistor N1 or N2 also increases and so will the VGD increase. Since Vo=Io*R3+$V_{GS}$, the output current Io corresponding to the same output voltage Vo will decrease accordingly. Meanwhile, the threshold voltage Vt' of the transistor N3 also increase due to the process deviation. According to the relation between the current Is and voltage $V_{GS}$ in the transistor N3 which is expressed as: Is=K*($V_{GS}$−Vt')^2, wherein Is and K are constants, when the value of Vt' increases, the value of $V_{GS}$ will increases and so will the value of the voltage V1, which is equal to Is*R5+$V_{GS}$, increase accordingly. Consequently, the output voltage Vo will increase accordingly to offset the decrease in the output current Io. On the contrary, when the threshold voltage Vt of the transistor N1 and N2 decreases due to the process deviation, the output voltage Vo will decrease to offset the output current Io.

Besides, according to the above deduction, when the resistor R3 and the threshold voltage Vt of the transistor N1 or N2 in the first voltage-drop device 250 are shifted at the same time due to the process deviation and cause the output current Io to deviate, the resistor R5 and the threshold voltage Vt' of transistor N3 in the second voltage-drop device 220 will also be shifted at the same time due to the process deviation and have the same feature in process deviation with the resistor R3 and transistor N1 respectively so as to offset the output current Io.

Preferred Embodiment Two

Figure 3A:
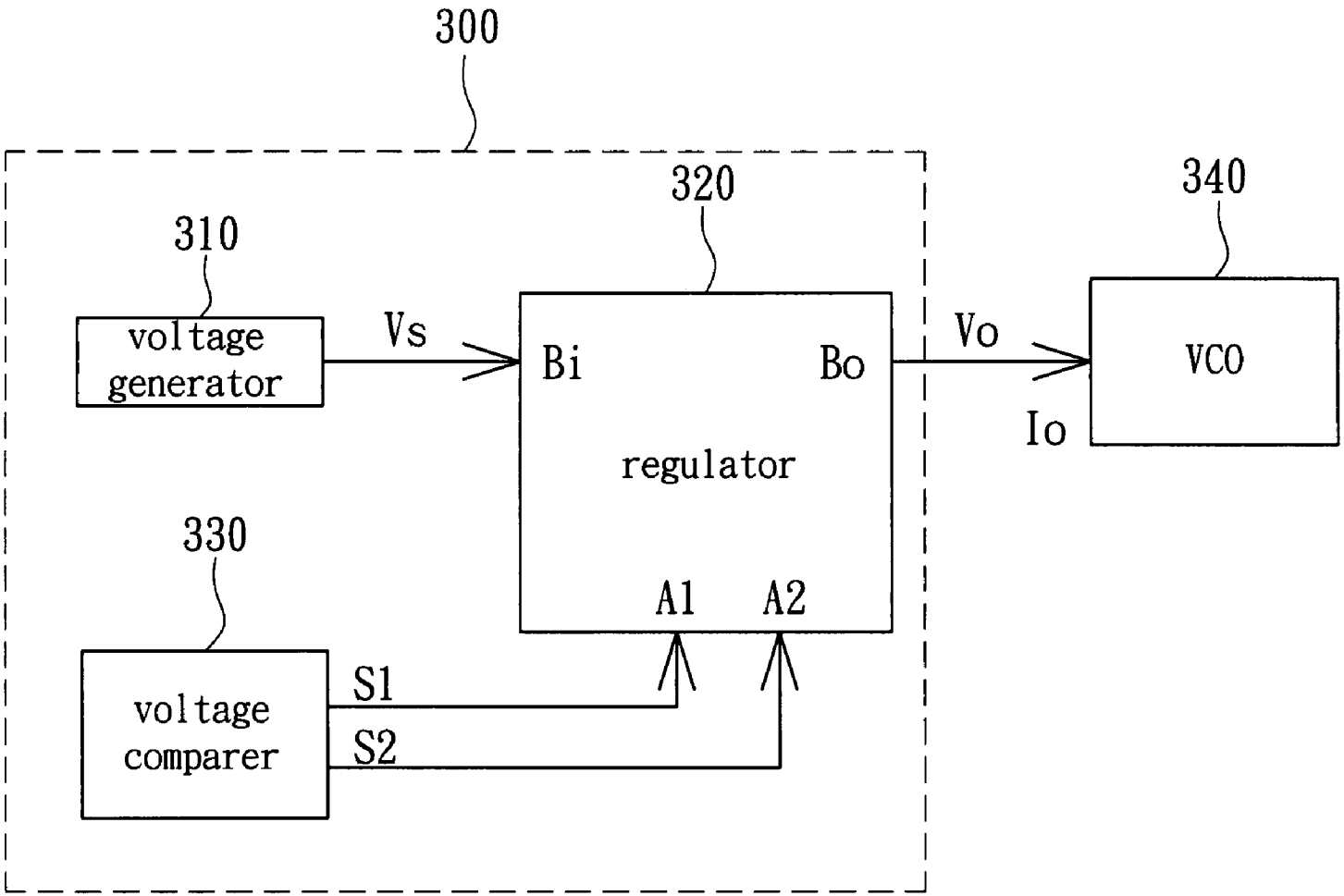
FIG. 3A is a circuit diagram of a voltage supplying apparatus according to the second preferred embodiment of the invention.

Referring to FIG. 3A, a circuit diagram of a voltage supplying apparatus according to the second preferred embodiment of the invention is shown. The voltage supplying apparatus 300 is for supplying VCO 340 an output voltage Vo (an operating voltage Vcc, say, 2V for instance) and the corresponding output current Io. The voltage supplying apparatus 300 includes a voltage generator 310, a regulator 320, and a voltage comparer 330. The voltage generator 310 is for providing a constant voltage Vs, such as a conventional band gap reference voltage, say, Vs=1.2V for instance. The regulator 320 is for stabilizing the output voltage Vo. The regulator 320 includes a voltage input terminal Bi, a first controlled terminal A1, a second controlled terminal A2, and a voltage output terminal Bo. The voltage input terminal Bi couples the voltage generator 310 and the voltage output terminal Bo is for outputting the output voltage Vo. Unlike the first preferred embodiment, the voltage supplying apparatus 300 in the second preferred embodiment maintains the conventional voltage generator 310 and further installs a voltage comparer 330 for adjusting the output voltage Vo. The voltage comparer 330 can output the first adjusting signal S1 and the second adjusting signal S2 to the first controlled terminal A1 and second controlled terminal A2 of the regulator 320 respectively to digitally adjust the output voltage Vo.

Figure 3B:
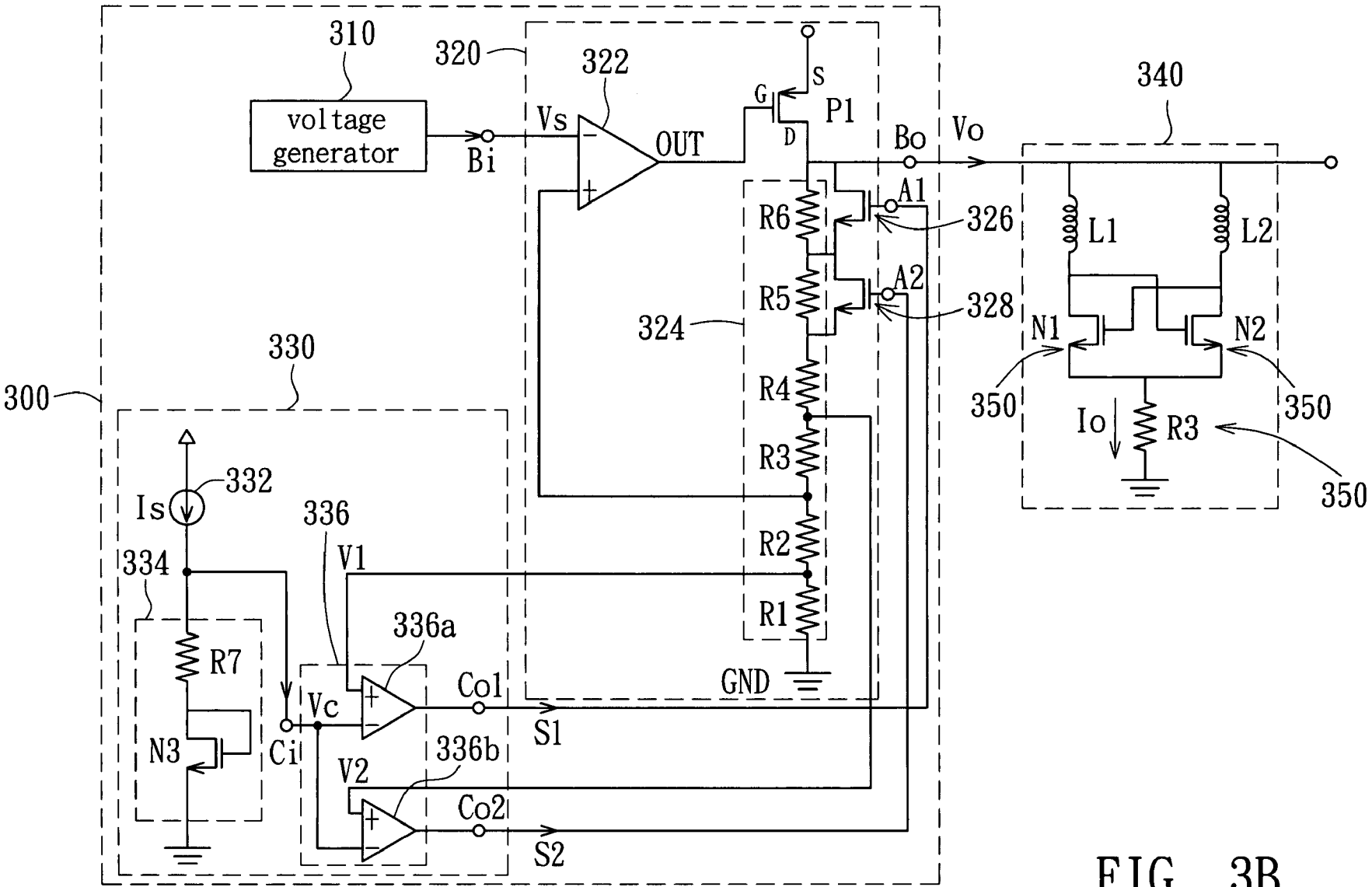
FIG. 3B shows a circuit structure diagram of the voltage supplying apparatus illustrated in FIG. 3A and a main circuit diagram of the VCO coupled thereto.

Referring to FIG. 3B, a circuit structure diagram of the voltage supplying apparatus 300 illustrated in FIG. 3A and a main circuit diagram of the VCO coupled thereto is shown. Similar to the above-mentioned VCO 240, VCO 340 includes a first voltage-drop device 350, a resistor R8, and a transistor N1 or N2 for instance, wherein the transistors N1 and N2 are both NMOS transistors and have the same feature in process deviation. The regulator 320 includes an amplifier 322, a PMOS transistor P1, a load circuit 324, a first switch 326, and a second switch 328. The negative input terminal (−) of the amplifier 322 is coupled with the voltage input terminal Bi and has a voltage Vs, while the output terminal OUT of the amplifier 322 is coupled with the gate electrode G of the transistor P1. The drain electrode D of the transistor P1 couples the voltage output terminal Bo and serially connects one end of the load circuit 324 with the other end of the load circuit 324 connected to the grounding terminal GND. The load circuit 324, from the drain electrode D to the grounding terminal GND, serially connects a resistor R6, a resistor R5, a resistor R4, a resistor R3, a resistor R2, and a resistor R1. The positive input terminal (+) of the amplifier 322 couples the joint of the resistor R2 and resistor R3 of the load circuit 324 to form a feedback circuit. The first switch 326, which is bridged over the resistor R6, can be a NMOS transistor for instance, wherein the gate electrode of the first switch 326 couples the first controlled terminal A1. The second switch 328, which is bridged over the resistor R5, can be a NMOS transistor for instance, wherein the gate electrode of the second switch 328 couples the second controlled terminal A2.

Besides, the voltage comparer 330 includes a current source 332, a second voltage-drop device 334, and a comparison unit 336. The current source 332 is for providing a constant current Is; while the second voltage-drop device 334 couples the current source Is and has the same feature in process deviation with the first voltage-drop device 350. According to the contents of the first voltage-drop device 350 including the resistor R3 and the transistor N1 or N2 disclosed above, the second voltage-drop device 334 chosen includes a resistor R7 and a transistor N3, which serially connects the resistor R7, wherein the transistor N3 and the transistor N1 or N2 are NMOS transistors of the same type, furthermore, the gate electrode G3 and drain electrode D3 of the transistor N3 are connected together. As disclosed in the first preferred embodiment, the second voltage-drop device 334 and the first voltage-drop device 350 have the same feature in process deviation. That is to say, the resistor R7 and the resistor R8 have the same direction in resistance deviation caused by temperature deviation or process deviation, and that the transistor N3 and the transistor N1 or N2 have the same direction in threshold voltage deviation caused by temperature deviation or process deviation.

The comparison unit 336 includes a comparison input terminal Ci, a first adjusting output terminal Co1, and a second adjusting output terminal Co2. The comparison input terminal Ci is coupled with the current source 332 and has a comparison voltage Vc for comparing with the first biased voltage V1 and the second biased voltage V2, wherein the first biased voltage V1 is smaller than the second biased voltage V2, for example, V1=1.1V while V2=1.3V. When the second voltage-drop device 334 does not shift due to the process deviation, the comparison voltage Vc (=Vci) is between the first biased voltage V1 and the second biased voltage V2. For example, the value of the Vci (=1.2V) is the average of the first biased voltage V1 and the second biased voltage V2. The first adjusting output terminal Co1 will output a first adjusting signal S1 to the first controlled terminal A1 according to the comparison between the comparison voltage Vc and the first biased voltage V1, while the second adjusting output terminal Co2 will output a second adjusting signal S2 to the second controlled terminal A2 according to the comparison between the comparison voltage Vc and the second biased voltage V2.

The comparison unit 336 further includes a first comparer 336*a* and a second comparer 336*b*. Of the first comparer 336*a*, the positive input terminal (+) receives an input of first biased voltage V1, the negative input terminal (−) is coupled with the comparison input terminal Ci, and the output terminal is coupled with the first adjusting output terminal Co1. Of the second comparer 336*b*, the positive input terminal (+) receives an input of second biased voltage V2, the negative input terminal (−) is coupled with the comparison input terminal Ci, and the output terminal is coupled with the second adjusting output terminal Co2. The positive input terminal (+) of the first comparer 336*a* disclosed above can be coupled with the joint of the resistor R2 and resistor R1 in the load circuit 324 of the regulator 320 to receive an input of first biased voltage V1(=Vs*R1/(R1+R2)); while the positive input terminal (+) of the second comparer 336*b* can also be coupled with the joint of the resistor R4 and resistor R3 in the load circuit 324 of the regulator 320 to receive an input of second biased voltage V2 (=Vs*(R1+R2+R3)/(R1+R2)). When the comparison voltage Vc equals Vci (V1<Vci<V2), the first adjusting signal S1 is at a low level and the second adjusting signal S2 is at a high level, the first switch 326 is not conducted but the second switch 328 is conducted, i.e., the resistor R5 is regarded as short-circuited. Therefore, the output voltage Vo=Vs*(R1+R2+R3+R4+R6)/(R1+R2) is Vn, the value of a normal voltage.

When the first voltage-drop device 350 such as the resistor R8 increases due to the process deviation, the output current Io corresponding to the output voltage Vo will decrease accordingly. Meanwhile, the resistor R7 of the second voltage-drop device 334 will increase due to the process deviation. Given that the comparison voltage Vc=Is*R7+$V_{GS}$ and that Is and $V_{GS}$ do not shift, the voltage Vc will increase accordingly (for example, become larger than Vci=1.2V). If the increased comparison voltage Vc still ranges between the first biased voltage V1 (say, 1.1V) and the second biased voltage V2 (say, 1.3V), the first adjusting signal S1 outputted by the first comparer 336*a* will still be at the low level and the second adjusting signal S2 outputted by the second comparer 336*b* will still be at the high level. Therefore, the output voltage Vo will still be equal to the normal voltage Vn and will not offset the output current Io. If the increased comparison voltage Vc is larger than the second biased voltage V2, the first adjusting signal S1 outputted by the first comparer 336*a* will be at the low level, but the second adjusting signal S2 outputted by the second comparer 336*b* will be shifted to the low level. That is to say, both the first switch 326 and the second switch 328 are not conducted. Therefore, the output voltage Vo=Vs*(R1+R2+R3+R4+R5+R6)/(R1+R2) is larger than the normal voltage Vn so as to offset the decrease in the output current Io.

On the contrary, when the resistor R8 decreases due to the process deviation, the output current Io corresponding to the output voltage Vo will increase accordingly. Meanwhile, the resistor R7 of the second voltage-drop device 334 will decrease due to process deviation accordingly. Given that comparison voltage Vc=Is*R7+$V_{GS}$ and that both Is and $V_{GS}$ are not shifted, the voltage Vc (Vc<Vci=1.2V) will decrease accordingly. If the decreased comparison voltage Vc still ranges between the first biased voltage V1 (=1.1V) and the second biased voltage V2 (=1.3V), the output voltage Vo will still be the normal voltage Vn and will not offset the output current Io. If the decreased comparison voltage Vc is smaller than the first biased voltage V1, the first adjusting signal S1 outputted by the first comparer 336*a* will be at the high level, and the second adjusting signal S2 outputted by the second comparer 336*b* output will be at the high level as well. That is to say, both the first switch 326 and the second switch 328 are conducted, while the resistors R5 and R6 are regarded short-circuited. Therefore, the output voltage Vo=Vs*(R1+R2+R3+R4)/(R1+R2) is apparently smaller than the normal voltage Vn, so as to offset the increase in the output current Io.

Similarly, when the threshold voltage Vt of the transistor N1 in the first voltage-drop device 350 increases due to the process deviation, the $V_{GS}$ of the transistor N1 or N2 will increase and so will the $V_{GD}$. While Vo=Io*R8+$V_{GS}$, the output current Io corresponding to the same the output voltage Vo will decrease accordingly. Meanwhile, the threshold voltage Vt' of the transistor N3 of the second voltage-drop device 334 will increase due to the process deviation. According to the equation $Is=K*(V_{GS}-Vt')^2$, where both Is and K constants, when the value of the Vt' increases, the value of the $V_{GS}$ will increase as well, and so will the value of the voltage Vc ($=Is*R7+V_{GS}$) increase (Vc>Vci=1.2V). If the increased comparison voltage Vc still ranges between the first biased voltage V1 (=1.1V) and the second biased voltage V2 (=1.3V), the output voltage Vo will still be at the normal voltage Vn and will not offset the output current Io. If the increased comparison voltage Vc is larger than the second biased voltage V2, the output voltage Vo=Vs*(R1+R2+R3+R4+R5+R6)/(R1+R2) will be larger than the normal voltage Vn so as to offset the decrease in the output current Io. On the contrary, when the threshold voltage Vt of the transistor N1 decreases due to the process deviation, the threshold voltage Vt' of the transistor N3 will decrease and so will the comparison voltage Vc will decrease. If the decreased comparison voltage Vc still ranges between the first biased voltage V1 and the second biased voltage V2, the output voltage Vo will be at the normal voltage Vn and will not offset the output current Io. If the decreased comparison voltage Vc is smaller than the first biased voltage V1, the output voltage Vo will also be smaller than normal voltage Vn so as to offset the increase in the output current Io.

Besides, when the resistor R8 and the threshold voltage Vt of the transistor N1 in the first voltage-drop device 350 is shifted due to the process deviation and causes the output current Io to deviate, the transistor R7 and the threshold voltage Vt' of the transistor N3 in the second voltage-drop device 334 will be shifted due to the process deviation accordingly, and has the same feature in process deviation with the resistor R8 and transistor N1. Therefore, if the comparison voltage Vc is only slightly shifted due to the process deviation of the second voltage-drop device 334 and still ranges between the first biased voltage V1 and the second biased voltage V2, the output voltage Vo will maintain the normal voltage Vn and will not offset the output current Io. If the deviation in the comparison voltage Vc is beyond the scope of the first biased voltage V1 and the second biased voltage V2, the output voltage Vo will be shifted accordingly so as to offset the output current Io. Therefore, the voltage supplying apparatus 300 in the second preferred embodiment can digitally adjust the output voltage Vo so as to offset the output current Io.

In the second preferred embodiment of the invention, despite that the first biased voltage V1 and the second biased voltage V2 provided by the load circuit 324 of the regulator 320 are taken as an example, however, the first biased voltage V1 and the second biased voltage V2 of the voltage supplying apparatus 300 of the invention can also be supplied by other power sources independently, furthermore, only the resistor R6, the resistor R5, the resistor R3' (equivalent to the resistor R3 and R4) and the resistor R1' (equivalent to the resistor R1 and R2) need to be serially connected in the load circuit 324. Although the invention is exemplified by the first biased voltage V1=1.1V, the second biased voltage V2=1.3V, and the comparison voltage Vci=1.2V, the invention can also use various first biased voltages V1, second biased voltages V2, and comparison voltages Vci to achieve the above object of adjusting the output voltage Vo so as to offset the output current Io as long as the comparison voltage Vci is between the first biased voltage V1 and the second biased voltage V2, wherein the first biased voltage V1 and the second biased voltage V2 have different voltage values.

Moreover, the disposition of the positive and negative input terminals of the first comparer 336*a* can also be exchanged; the corresponding first switch 326 can be moved downward to be bridged over the resistor R2 or R1 disposed below the junction of the load circuit 324 and the positive input terminal of the amplifier 322 (suppose that the first biased voltage V1 and the second biased voltage V2 are supplied by other power sources). Meanwhile, if the comparison voltage Vc is between the value of V1 and the value of V2, both the first adjusting signal S1 and the second adjusting signal S2 are at high levels, and both the first switch 326 and the second switch 328 are conducted, which means the resistor R5 and the resistor R2 are both short-circuited. Therefore, the value of the output voltage Vo=Vs*(R1+R3+R4+R6)/R1 equals the value of the normal voltage Vn. If the comparison voltage Vc is smaller than the value of V1, the first adjusting signal S1 is at the low level, and the second adjusting signal S2 is at the high level. Meanwhile, the first switch 326 is not conducted, but the second switch 328 is conducted, which means the resistor R5 is short-circuited. Therefore, the value of the output voltage Vo=Vs*(R1+R2+R3+R4+R6)/(R1+R2) is smaller than the value of the normal voltage Vn=Vs*(R1+R3+R4+R6)/R1 so as to offset the output current Io. If the value of the comparison voltage Vc is larger than the value of V2, the first adjusting signal S1 is at the high level, while the second adjusting signal S2 is at the low level. Meanwhile, the first switch 326 is conducted, which means the resistor R2 is short-circuited, but the second switch 328 is not conducted. Therefore, the output voltage Vo=Vs*(R1+R3+R4+R5+R6)/R1 is larger than the normal voltage Vn=Vs*(R1+R3+R4+R6)/R1 so as to offset the output current Io. Similarly, the disposition of the positive and negative input terminals of the second comparer 336*b* can also be exchanged and the corresponding second switch 328 can be moved downward to be bridged over the resistor R2 or R1 disposed at the lower part of the load circuit 324 so as to offset the output current Io. However, if the first switch 326 and the second switch 328 are both shifted to the resistor R1, R2 disposed on the lower part of the load circuit 324, an additional resistor has to be installed on the lower part of the load circuit 324, lest the positive input terminal of the amplifier 322 will be grounded directly if the resistors R1 and R2 are both short-circuited.

Although the VCO is exemplified in the first preferred embodiment and the second preferred embodiment of the invention, the voltage supplying apparatuses 200 and 300 of the invention can also be applied to any other electronic circuits having voltage-drop devices such as a resistor or a transistor. To achieve the same object of offsetting the output current Io, the user only needs to chose a resistor and a transistor according to the voltage-drop device of the electronic circuit to be serially connected to the current sources 210 and 332 of the voltage supplying apparatuses 200 and 300 of the invention, wherein the chosen transistor and resistor are of the same type and have the same feature in the process deviation.

According to the two preferred embodiments of the invention disclosed above, the voltage supplying apparatus of the invention has the following advantage. A fixed current source is coupled to the input terminal of a conventional regulator, and the resistor and transistor, which are of the same type and have the same feature in the process deviation with the resistor or transistor included in the voltage-drop device of the electronic circuit subsequently coupled to the regulator, are serially connected to the current source. Therefore, when the voltage-drop device included in the electronic circuit causes the electronic circuit to generate input current deviation due to process deviation, the voltage supplying apparatus can use its corresponding voltage-drop device, which shifts accordingly due to the process deviation to adjust the output voltage of the regulator to offset the output current. Alternatively, an additional voltage comparer can be installed in the conventional circuit of the regulator coupled by the voltage generator to control the resistance value of the load circuit in the regulator so as to digitally adjust the output voltage to offset the current inputted to the electronic circuit coupled to the regulator, lest the input current deviation might affect the normal operation of the electronic circuit.

While the invention has been described by way of example and in terms of two preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A voltage supplying apparatus for supplying an output voltage to an electronic circuit, the electronic circuit having a first voltage-drop device, the voltage supplying apparatus comprises:

a current source for providing a constant current;

a second voltage-drop device, coupled with the current source, the second voltage-drop device having the same feature in process deviation with the first voltage-drop device; and a regulator for stabilizing the output voltage, the regulator comprising:

a voltage input terminal, coupled with the current source, the voltage input terminal having a first voltage corresponding to the output voltage; and a voltage output terminal, for outputting the output voltage, the voltage output terminal having an output current;

wherein when the output current generates deviation due to the process deviation of the first voltage-drop device, the first voltage is shifted accordingly due to the process deviation of the second voltage-drop device to offset the output current.

2. The voltage supplying apparatus according to claim 1, wherein the electronic device is a voltage control oscillator (VCO), and the output voltage is an operating voltage of the voltage control oscillator.

3. The voltage supplying apparatus according to claim 1, wherein the first voltage-drop device and the second voltage-drop device are resistors.

4. The voltage supplying apparatus according to claim 1, wherein the first voltage-drop device and the second voltage-drop device are transistors of the same type.

5. The voltage supplying apparatus according to claim 4, wherein threshold voltages of the transistors are shifted due to the process deviation.

6. The voltage supplying apparatus according to claim 1, wherein the first voltage-drop device comprises a first resistor and a first transistor, and the second voltage-drop device is a second resistor serially connected to a second transistor.

7. The voltage supplying apparatus according to claim 6, wherein the first voltage-drop device and the second voltage-drop device have the same feature in process deviation means that the first resistor and the second resistor have the same feature in process deviation, and the first transistor and the second transistor have the same feature in process deviation.

8. The voltage supplying apparatus according to claim 1, wherein a direct proportion exists between the first voltage and the output voltage.

9. A voltage supplying apparatus for supplying an output voltage to an electronic circuit, the electronic circuit having a first voltage-drop device, the output voltage corresponding to an output current, the voltage supplying apparatus comprising:

a voltage generator for providing a constant voltage;

a regulator for stabilizing the output voltage, the regulator comprising:

a voltage input terminal, coupled with the voltage generator;

a first controlled terminal;

a second controlled terminal; and a voltage output terminal for outputting the output voltage; and a voltage comparer for adjusting the output voltage, the voltage comparer comprising:

a current source for providing a constant current;

a second voltage-drop device, coupled with the current source, the second voltage-drop device having the same feature in process deviation with the first voltage-drop device; and a comparison unit, comprising:

a comparison input terminal, coupled with the current source, the comparison input terminal having a comparison voltage for comparing with a first biased voltage and a second biased voltage, wherein the first biased voltage is smaller than the second biased voltage, and when the second voltage-drop device does not shift due to the manufacturing process, the comparison voltage is between the first biased voltage and the second biased voltage;

a first adjusting output terminal for outputting a first adjusting signal to the first controlled terminal according to the comparison between the comparison voltage and the first biased voltage; and a second adjusting output terminal for outputting a second adjusting signal to the second controlled terminal according to the comparison between the comparison voltage and the second biased voltage;

wherein when the output current generates deviation due to the process deviation of the first voltage-drop device, the comparison voltage also shifts according to the process deviation of the second voltage-drop device, and when the comparison voltage is shifted to be between the first biased voltage and the second biased voltage, the first adjusting signal is at a first level, the second adjusting signal is at a second level, and the output voltage is a normal voltage; whereas when the comparison voltage is shifted to be smaller than the first biased voltage, the first adjusting signal is at a third level, the second adjusting signal is at the second level, and the output voltage is lower than the normal voltage to offset the output current, and when the comparison voltage is shifted to be larger than the second biased voltage, the first adjusting signal is at the first level, the second adjusting signal is at a fourth level, and the output voltage is higher than the normal voltage to offset the output current.

10. The voltage supplying apparatus according to claim 9, wherein the electronic device is a voltage control oscillator, and the output voltage is an operating voltage of the voltage control oscillator.

11. The voltage supplying apparatus according to claim 9, wherein the first voltage-drop device and the second voltage-drop device are resistors.

12. The voltage supplying apparatus according to claim 9, wherein the first voltage-drop device and the second voltage-drop device are transistors of the same type.

13. The voltage supplying apparatus according to claim 9, wherein the first voltage-drop device comprises a first resistor and a first transistor, and the second voltage-drop device is a second resistor serially connected to a second transistor.

14. The voltage supplying apparatus according to claim 13, wherein the first voltage-drop device and the second voltage-drop device have the same feature in process deviation means that the first resistor and the second resistor have the same feature in process deviation, and the first transistor and the second transistor have the same feature in process deviation.

15. The voltage supplying apparatus according to claim 9, wherein the first level and the second level are different voltage levels, the third level and the fourth level are different voltage levels.

16. The voltage supplying apparatus according to claim 9, wherein the comparison unit further comprises:

a first comparer, comprising:

a first positive input terminal for receiving the input of the first biased voltage;

a first negative input terminal coupled with the comparison input terminal; and a first output terminal coupled with the first adjusting output terminal; and a second comparer, comprising:

a second positive input terminal for receiving the input of the second biased voltage;

a second negative input terminal coupled with the comparison input terminal; and a second output terminal coupled with the second adjusting output terminal.

17. The voltage supplying apparatus according to claim 16, wherein the first level is a low level and the second level is a high level, while the third level is the high level and the fourth level is the low level.

18. The voltage supplying apparatus according to claim 9, wherein the regulator comprises:

an amplifier, comprising a third negative input terminal coupled with the voltage input terminal, a third positive input terminal, and a third output terminal;

a P-typed metal oxide semiconductor transistor, comprising:

a gate electrode coupled with the third output terminal; and a drain electrode coupled with the voltage output terminal;

a load circuit, serially connected between the drain electrode and a grounding terminal, the load circuit starting from the drain electrode, serially connects a first resistor, a second resistor, a third resistor, and a fourth resistor in a sequentially order, wherein the third positive input terminal is coupled with the joint of the third resistor and fourth resistor of the load circuit to form a feedback circuit;

a first switch, bridged over the first resistor, the first switch comprising a first input terminal coupled with the first controlled terminal; and a second switch, bridged over the second resistor, the second switch comprising a second input terminal coupled with the second controlled terminal;

wherein when the first adjusting signal is at the first level, the first switch unit is not conducted, when the first adjusting signal is at the third level, the first switch unit is conducted; whereas when the second adjusting signal is at the second level, the second switch is conducted, furthermore, and when the second adjusting signal is at the fourth level, the second switch is not conducted.

19. The voltage supplying apparatus according to claim 9, wherein the constant voltage is a band gap reference voltage.

20. The voltage supplying apparatus according to claim 9, wherein when the second voltage-drop device does not shift due to the process deviation, the comparison voltage is the average value of the first biased voltage and the second biased voltage.

* * * * *

UNITED STATES PATENT AND TRADEMARK OFFICE

CERTIFICATE OF CORRECTION

PATENT NO. : 7,095,270 B2
APPLICATION NO. : 10/989506
DATED : August 22, 2009
INVENTOR(S) : Yu-Hua Liu It is certified that error appears in the above-identified patent and that said Letters Patent is hereby corrected as shown below:

On the Title Page:

After Item (65) Prior Publication Data, please add Item (30):

-- Foreign Application Priority Data
November 18, 2003 (TW).....092132345 --

Signed and Sealed this

Fifteenth Day of September, 2009

David J. Kappos

David J. Kappos
*Director of the United States Patent and Trademark Office*